US010500754B2

(12) United States Patent
Towner et al.

(10) Patent No.: US 10,500,754 B2
(45) Date of Patent: Dec. 10, 2019

(54) BATTERY OPERATED CHAIN SAW UNIT AND METHOD OF CONSTRUCTING THE SAME

(71) Applicant: ECHO INCORPORATED, Lake Zurich, IL (US)

(72) Inventors: Stephen J. Towner, Gurnee, IL (US); Brent Peterson, Buffalo Grove, IL (US)

(73) Assignee: Echo Incorporated, Lake Zurich, IL (US)

( * ) Notice: Subject to any disclaimer, the term of this patent is extended or adjusted under 35 U.S.C. 154(b) by 103 days.

(21) Appl. No.: 15/827,451

(22) Filed: Nov. 30, 2017

(65) Prior Publication Data

US 2018/0079101 A1 Mar. 22, 2018

Related U.S. Application Data

(63) Continuation-in-part of application No. 15/047,873, filed on Feb. 19, 2016, now Pat. No. 9,855,671.

(60) Provisional application No. 62/278,743, filed on Jan. 14, 2016.

(51) Int. Cl.
*B27B 17/00* (2006.01)
*B27B 17/08* (2006.01)

(52) U.S. Cl.
CPC ..... *B27B 17/08* (2013.01); *B27B 17/00* (2013.01); *B27B 17/0008* (2013.01)

(58) Field of Classification Search
CPC ..... B27B 17/08; B27B 17/00; B27B 17/0008; B25F 5/008; A01G 3/053
See application file for complete search history.

(56) References Cited

U.S. PATENT DOCUMENTS

2010/0218385 A1* 9/2010 Mang ..... A01G 3/053 30/216
2012/0066916 A1* 3/2012 Heinzelmann ..... B25F 5/008 30/381
2016/0336557 A1* 11/2016 Miller ..... A01D 34/416
2017/0297216 A1* 10/2017 Kachi ..... B27B 17/00

* cited by examiner

*Primary Examiner* — Jun S Yoo
(74) *Attorney, Agent, or Firm* — Wood, Phillips, Katz, Clark & Mortimer

(57) ABSTRACT

A chain saw unit and a method of constructing the same. The method includes the steps of obtaining: a) an endo-skeletal sub-frame assembly defining a plurality of mount locations; b) a plurality of operating components; and c) an outer housing assembly; directing one of the operating components laterally into an operative position at one of the mount locations at one of the sides of the endo-skeletal sub-frame assembly; placing at least one additional operating component into an operative position to define a main operating unit; and after directing the one of the operating components into its operative position, placing at least a part of the outer housing assembly in an operative position with respect to the endo-skeletal sub-frame assembly wherein the at least part of the outer housing assembly overlies part of the exposed surface area of the main operating unit and blocks access to the operatively positioned one component from the one side of the endo-skeletal sub-frame assembly.

24 Claims, 6 Drawing Sheets

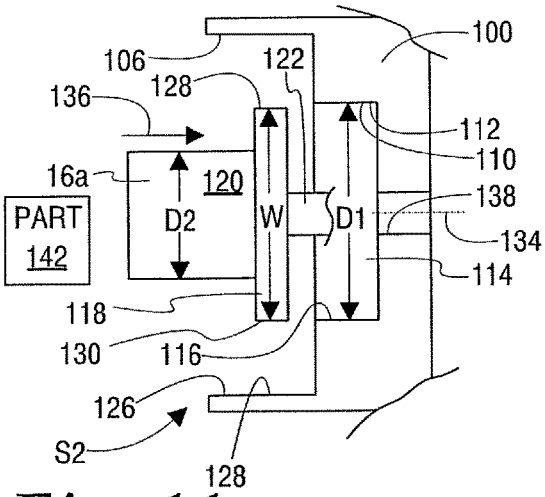
Fig. 11
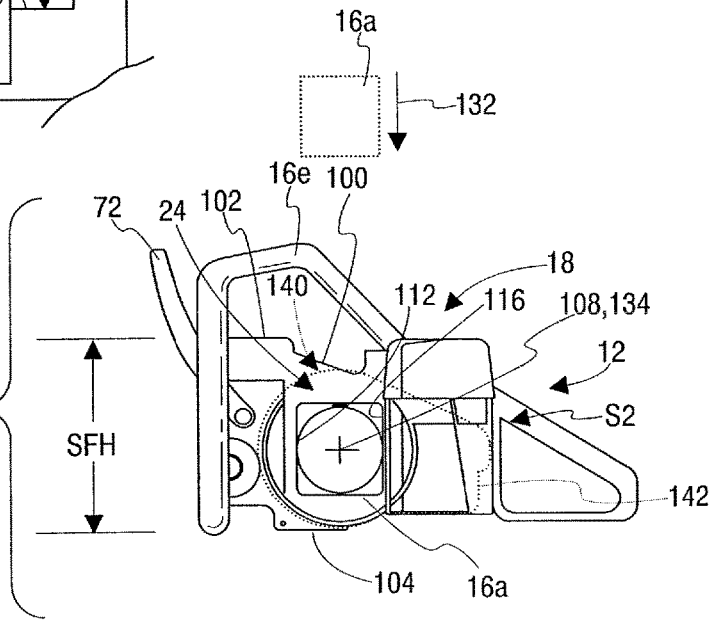
Fig. 10
Fig. 12
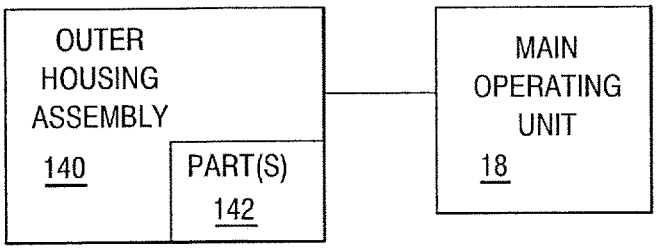
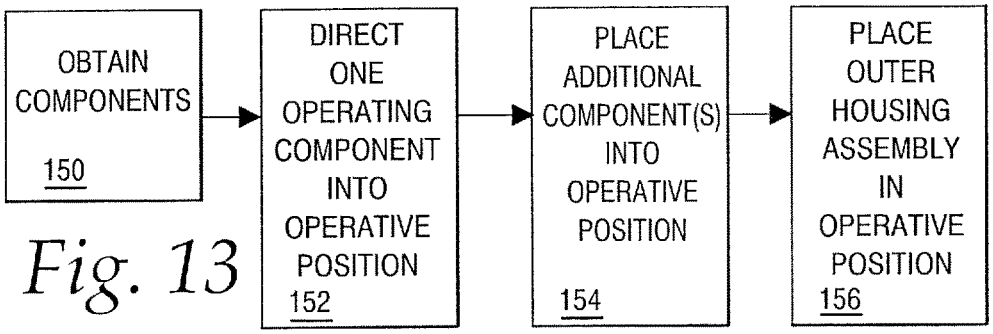
Fig. 13

BATTERY OPERATED CHAIN SAW UNIT AND METHOD OF CONSTRUCTING THE SAME

CROSS-REFERENCE TO RELATED APPLICATIONS

This application is a continuation-in-part of U.S. patent application Ser. No. 15/047,873 filed Feb. 19, 2016.

BACKGROUND OF THE INVENTION

Field of the Invention

This invention relates to portable saws and, more particularly, to a saw having a cutting chain driven by a battery operated motor.

Background Art

Portable saws that utilize a driven cutting chain have been in existence for many decades. In a typical construction, a cutting chain is trained in a track on a cutting bar to move in an endless path. A drive component, which may be in the form of a sprocket or the like, is rotated through a motor to effect driving of the chain.

Chain saws designed for even light, non-professional, use are routinely subjected to heavy loading. Thus, motors for chain saws have generally all been required to generate a relatively high power output.

While battery operated chain saws have been developed over the years, until recently, limitations on battery technology have prevented widespread commercial acceptance of battery operated chain saws as a viable alternative to chain saws with fuel powered engines. Generally, batteries have been deficient in terms of their power output capability as well as their running time between charges. The inability to practically control size and weight of batteries has also impeded the transition from fuel operated chain saws to those powered by batteries.

In recent years, there has been a very dramatic improvement in battery technology that has prompted the use of batteries in a wide range of new product categories, including in chain saws for both non-professional and professional applications. For example, lithium ion battery technology has advanced to the point that compact, relatively lightweight batteries can produce power at levels achievable in the past only through combustion-type engines. This and other advancements in battery technology have led to a very significant industry trend towards supplanting long used lines of chain saws built around combustion engines with those utilizing battery operated drive motors. This trend has been bolstered additionally by the fact that battery operated chain saws have a number of significant functional advantages compared to those built around combustion engines.

Battery operated chain saws generally can operate with less vibration. Battery operated chain saws can also be designed to generate significantly less noise during operation. Importantly, designers of battery operated chain saws do not have to contend with emission control, that has been a vexatious problem, particularly as many jurisdictions adopt increasingly tougher standards for all fuel powered engines.

A major shift in technologies, such as that described above for the chain saw, creates unique challenges for those in this industry. Resources dedicated in the past to highly successful fuel driven products must be diverted to meet anticipated customer demands for battery operated technology. New resources must be allocated for designing, conducting research and development with respect to, and manufacturing, battery operated products. Such a drastic change in direction for some companies may be catastrophic, since they may ultimately be caused to abandon facilities and practices that progressively evolved and were perfected over many decades, and are peculiar to, and not readily adaptable to, the fuel operated model.

Chain saws utilizing combustion engines have heretofore commonly been built around an internal structural frame that results in an endo-skeletal design. That is, the frame is configured to accommodate all of the working components—namely, control boards, oil tanks, fuel tanks, engines, etc.—that are progressively built thereon. Operating handles have been connected to the frame typically through isolation structure that avoids vibration transmission to a user.

On the other hand, the evolving model for battery operated chain saws has predominantly used an exo-skeletal design. That is, the outer housing provides the foundation for the internal components. This model is typical of many battery operated and corded electrical devices that utilize a clam shell configuration.

This latter approach has a number of drawbacks. First of all, the outer housing/frame has a predetermined fixed shape that dictates the end appearance of the chain saw. Little flexibility is allowed in terms of modifying shape or aesthetics. Thus, little flexibility is afforded in differentiating the appearance of products that might have different operating features or capabilities. Essentially, only color and ornamentation, such as decals, are available to effect this differentiation.

Further, an outer frame construction inherently challenges designers to maintain overall structural rigidity, particularly since relatively large loading and impacts are applied to chain saws in their normal operating environment. These forces tend to distort the housing/frame. This distortion may lead to a compromising of the outer housing as well as the internal operating components. A failure of the outer housing may, in a worst case, render the chain saw inoperable and unsalvageable.

Aside from creating the challenge of producing a chain saw with an outer housing with structural integrity adequate to withstand the rigors of the normal operating environment, exo-skeletal construction generally complicates assembly and disassembly, as for repair.

Generally, exo-skeletal construction of chain saws uses a cup-shaped, upwardly opening outer housing assembly/frame that defines a component receptacle that is accessed from above. Such a structure is shown in U.S. Patent Application Publication No. 2012/0066916, to Heinzelmann et al. Components may be pre-assembled and placed into the receptacle and/or serially assembled within the receptacle.

In the former case it may be difficult to positively secure the components so that they are not prone to breaking loose during use. Even if a single block of components is pre-assembled, space must be afforded therearound to facilitate placement and securing, as through manipulated fasteners.

In the latter case, introducing components one-by-one may be difficult. First of all, maneuvering components around each other within the tight receptacle volume is inherently difficult. Space must be left to avoid interference between components and facilitate their ultimate securement.

Both of the above design approaches introduce levels of challenge and inconvenience that result in manufacturing inefficiency. Also, the need to afford a space adequate to maneuver components and tools within the receptacle inevitably results in an increase in overall volume of the completed chain saw unit, compared to a conventional non-battery operated chain saw.

Still further, in the event a repair is required that necessitates access to components in the receptacle, several other parts may have to be removed to gain required access through the top opening of the outer housing assembly. This adds to the complexity of the repair process. A substantial amount of time may be required to access a "buried" part to effect an otherwise simple repair.

As noted above, the new battery operated construction model generally forces personnel involved in all areas of product development, from design to marketing, to learn new processes and techniques. Past engineering practices and techniques, that were applicable to the internal frame construction (endo-skeletal design), may not be usable in a practical sense to design and produce chain saw products with the exo-skeletal design. Further, facilities used to produce fuel powered chain saws may not be practically convertible to allow production of battery powered chain saws.

Still further, as the transition to battery power is taking place, those in the industry may have to provide large volumes of both battery and fuel driven chain saws to the market. The inability to navigate the transitional period and eventually efficiently offer primarily the battery operated product line, may lead to the decline or outright demise of many heretofore successful enterprises.

In short, the chain saw industry has seen a radical shift in the construction of its product and how that product will be developed, manufactured, and marketed in the future. Entities that do not meet this challenge may face serious economic consequences. Businesses are in need of direction to allow them to meet the above challenges in the rapidly evolving industry which embraces battery technology over the familiar and highly evolved fuel operated engine technology.

SUMMARY OF THE INVENTION

In one form, the invention is directed to a method of constructing a chain saw unit for a chain saw of the type including a chain bar and a cutting chain guided in movement by the cutting bar. The method includes the steps of: obtaining: a) an endo-skeletal sub-frame assembly defining a plurality of mount locations; b) a plurality of operating components including at least; i) a battery operated motor; and ii) a drive transmission assembly through which a cutting chain can be driven by the battery operated motor; and c) an outer housing assembly; directing one of the operating components from a pre-assembly position into an operative position at one of the mount locations; placing additional ones of the operating components in operative positions, each at one of the mount locations, to define a main operating unit to which the chain bar and cutting chain can be operatively assembled so that the cutting chain can be driven by the battery operated motor; and after directing the one of the operating components into its operative position, placing at least a part of the outer housing assembly in an operative position with respect to the endo-skeletal sub-frame assembly. The endo-skeletal sub-frame assembly has a top, a bottom, a front, a rear, and laterally spaced sides. One of the sides of the endo-skeletal sub-frame assembly has an opening through which the operatively positioned one component is exposed to be accessed from the one side of the endo-skeletal sub-frame assembly. The main operating unit has an exposed surface area, a top, a bottom, and spaces sides. The at least part of the outer housing assembly overlies part of the exposed surface area of the main operating unit and blocks access to the operatively positioned one component through the opening from the one side of the endo-skeletal sub-frame assembly.

In one form, the one operating component is the battery operated motor.

In one form, the opening extends to adjacent the bottom of the endo-skeletal sub-frame assembly.

In one form, the endo-skeletal sub-frame assembly is a unitary piece that has at least one graspable handle.

In one form, the unitary piece is a single piece.

In one form, the at least part of the housing assembly in its operative position fully blocks the opening as viewed in a horizontal direction from the one side of the endo-skeletal sub-frame assembly.

In one form, the at least part of the housing assembly in its operative position substantially fully blocks the battery operated motor as viewed in a horizontal direction from the one side of the endo-skeletal sub-frame assembly.

In one form, the at least part of the housing assembly in its operative position directly overlies the exposed surface area of the main operating unit.

In one form, the at least part of the housing assembly in its operative position directly overlies the endo-skeletal frame assembly.

In one form, the battery operated motor is moved laterally in a first direction in a horizontal path between the pre-assembly position into the operative position. The at least part of the housing assembly in its operative position blocks movement of the battery operated motor from its operative position oppositely to the first direction in the horizontal path.

In one form, the main operating unit is functionally the same with and without the outer housing assembly in the operative position with respect to the endo-skeletal sub-frame assembly.

In one form, the single piece is a molded plastic piece.

In one form, the method further includes the steps of operatively assembling the chain bar and cutting chain to the main operating unit.

In one form, the outer housing assembly extends downwardly from the top of the main operating unit to a location closer to the bottom of the main operating unit than the top of the main operating unit. The battery operated motor is fixed to the endo-skeletal sub-frame assembly independently of the outer housing assembly, whereby an entirety of the outer housing assembly can be separated from the endo-skeletal sub-frame assembly without changing how the battery operated motor is maintained on the endo-skeletal sub-frame assembly.

In one form, the outer housing assembly extends to at least adjacent the bottom of the main operating unit.

In one form, with the chain saw unit fully assembled, the outer housing assembly overlies a majority of an exposed area of one of the sides of the main operating unit.

In one form, with the chain saw unit fully assembled, the outer housing assembly extends over one half a vertical extent of the one side of the endo-skeletal sub-frame assembly.

In one form, the invention is directed to a method of constructing a chain saw unit for a chain saw of the type including a chain bar and a cutting chain guided in movement by the cutting bar. The method includes the steps of: obtaining: a) an endo-skeletal sub-frame assembly defining a plurality of mount locations; b) a plurality of operating components including at least: i) a battery operated motor; and ii) a drive transmission assembly through which a cutting chain can be driven by the battery operated motor; and c) an outer housing assembly; directing one of the operating components laterally into an operative position at one of the mount locations at one of the sides of the endo-skeletal sub-frame assembly; placing additional ones of the operating components in operative positions, each at one of the mount locations, to define a main operating unit to which the chain bar and cutting chain can be operatively assembled so that the cutting chain can be driven by the battery operated motor; and, after directing the one of the operating components into its operative position, placing at least a part of the outer housing assembly in an operative position with respect to the endo-skeletal sub-frame assembly. The endo-skeletal sub-frame assembly has a top, a bottom, a front, a rear, and laterally spaced sides. The main operating unit has an exposed surface area, a top, a bottom, and spaced sides. The at least part of the outer housing assembly overlies part of the exposed surface area of the main operating unit and blocks access to the operatively positioned one component from the one side of the endo-skeletal sub-frame assembly.

In one form, the at least part of the outer housing in its operative position fully blocks access to the operatively positioned one component from the one side of the endo-skeletal sub-frame assembly.

In one form, the one operating component is the battery operated motor.

In one form, the outer housing assembly extends to at least adjacent the bottom of the main operating unit.

In one form, the invention is directed to a chain saw unit made according to the method described above.

BRIEF DESCRIPTION OF THE DRAWINGS

FIG. 10 is an enlarged, side elevation view of the sub-frame assembly and components as shown in FIGS. 6 and 7;

FIG. 11 is an enlarged, fragmentary, exploded, elevation view showing the relationship between the battery-operated motor and the sub-frame assembly;

FIG. 12 is a schematic representation of an outer housing assembly for the main operating unit; and FIG. 13 is a flow diagram representation of a method of constructing a chain saw unit according to the present invention.

DETAILED DESCRIPTION OF THE PREFERRED EMBODIMENT

Figure 1:
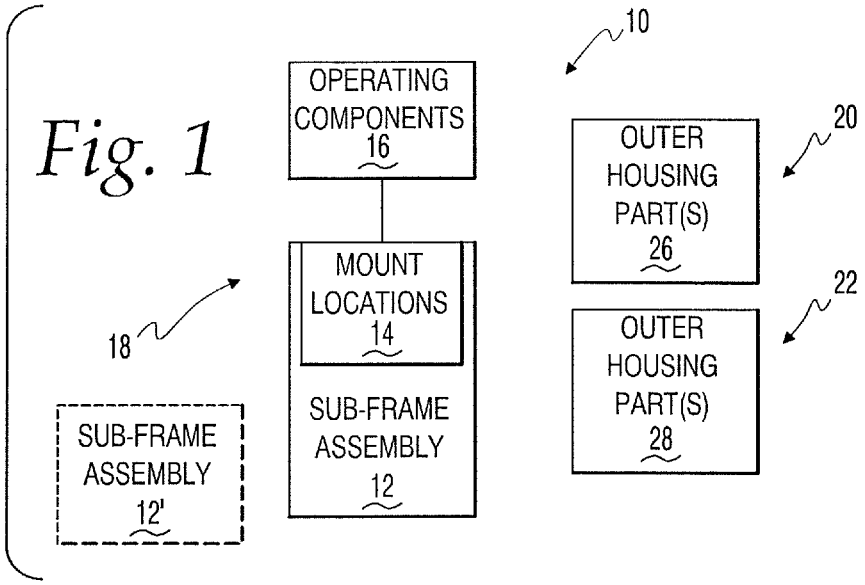
FIG. 1 is a schematic representation of a chain saw kit, according to the present invention, and including a main operating unit to which an outer housing assembly, selected from alternative outer housing assembly designs, can be mounted, one in place of the other.
Figure 2:
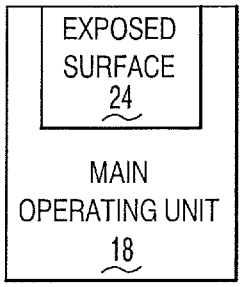
FIG. 2 is a schematic representation of the main operating unit and identifying an exposed surface thereon.
Figure 3:
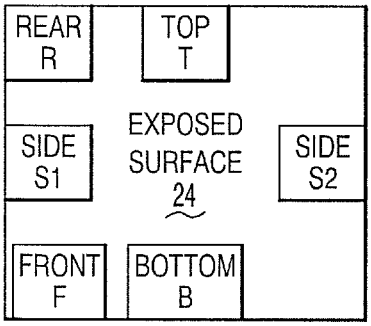
FIG. 3 is a schematic representation identifying different regions of the exposed surface on the main operating unit in FIG. 2.
Figure 4:
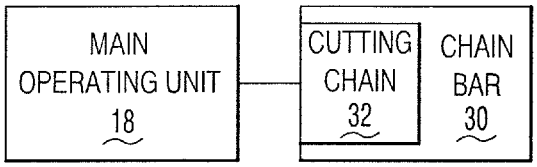
FIG. 4 is a schematic representation of the main operating unit joined to a cutting bar that operatively supports a cutting chain.

A chain saw kit, according to the present invention, is shown schematically at 10 in FIG. 1. The schematic showing in FIG. 1, as well as in FIGS. 2-4, is intended to encompass specific forms of chain saw components, as described in exemplary forms hereinbelow, and virtually an unlimited number of variations of those components and their interaction.

The base chain saw kit 10 consists of a sub-frame assembly 12 configured to define mount locations 14 at which each of a plurality of operating components 16 can be operatively placed and maintained so that the sub-frame assembly 12, in conjunction with the operatively placed operating components 16, make up at least a part of a main operating unit at 18. The plurality of operating components 16 includes at least a battery operated motor and a battery for supplying power to the motor.

The sub-frame assembly 12 is an endo-skeletal assembly, the significance of which is explained below. Basically, the endo-skeletal sub-frame assembly 12 defines a rigid foundation for an entire chain saw structure made up of components progressively built up on the sub-frame assembly 12.

The chain saw kit 10 further includes a first outer housing assembly at 20 and a second outer housing assembly at 22.

The main operating unit 18 and first and second outer housing assemblies 20, 22 are configured so that parts or all of the first and second outer housing assemblies 20, 22 can be operatively mounted selectively, one in place of the other, on the main operating unit 18 to define an assembled unit that has at least one of a different: a) size; b) shape; and c) appearance, with the first outer housing assembly 20 operatively mounted on the main operating unit 18 than with the second outer housing assembly 22 operatively mounted on the main operating unit 18.

As shown schematically in FIG. 2, the main operating unit 18 has an exposed surface 24. The first and second outer housing assemblies 20, 22, when operatively mounted on the main operating unit 18, overlie a substantial area of the exposed surface 24.

As shown further in schematic form in FIG. 3, the total area of the exposed surface 24 exists at several regions of the main operating unit 18—namely, a top T, a bottom B, spaced sides S1, S2, a rear R, and a front F.

The first and second outer housing assemblies 20, 22 may directly overlie the exposed surface 24 on the main operating unit 18. While this is preferred, the invention contemplates that at least one layer/component may reside between the first and second outer housing assemblies 20, 22 and the exposed surface 24.

To appreciably alter the size, shape, and/or appearance of the main operating unit 18, the outer housing assemblies 20, 22 overlie at least 10% of the area of the exposed surface 24. Preferably, the first and second outer housing assemblies 20, 22 overlie a significantly greater percentage of the area of the exposed surface 24—potentially up to 100% thereof. Generally, the greater the areal coverage, the greater the amount of change possible in overall size, shape, and appearance.

The first and second outer housing assemblies 20, 22 respectively are made up of at least one part 26, 28, as shown schematically in FIG. 1.

The first and second outer housing assemblies 20, 22, in one preferred form, overlie at least two of the top T, sides S1, S2, bottom B, rear R, and front F regions. Typically, the primary surface regions focused upon for placement of the outer housing assemblies 20, 22 are the top T, and sides S1, S2.

The particular operating components 16, which are operatively placed and maintained on the sub-frame assembly 12, may range significantly in terms of number and nature. A non-exhaustive list of such potential components includes: a) the aforementioned battery operated motor and battery; b) a control board assembly; c) an oil tank, that may be integrally formed as part of, or operatively placed on, the sub-frame assembly 12; d) one or more graspable operating handles, that may be integral with, or separately constructed and connected to, the sub-frame assembly 12; e) a throttle trigger; f) a stop switch; g) a chain break assembly; h) a drive transmission assembly acting between the motor and cutting chain; i) a tensioner assembly for the cutting chain; and j) other conventionally used operating components.

The selection of operating components 16 may involve different forms of the same type of operating component. For example, different motors may be interchangeably operatively placed at a particular mount location 14. A number of different battery operated motors may be kept on hand with different power ratings. Depending upon a particular model that is being constructed, an assembler will select an appropriate motor from the available options. The same sub-frame assembly 12 may be utilized to construct the main operating unit 18 with different features and performance characteristics.

The schematic showings are intended to encompass numerous different constructions. For example, the operating components 16 may be integrated into the sub-frame assembly 12 to define a fully functioning main operating unit 18 that does not depend on the presence of the first or second outer housing assemblies 20, 22 to be usable in its intended manner. Further, the main operating unit 18 may be configured to be functionally the same with or without the first and second outer housing assemblies 20, 22 mounted on the main operating unit 18.

Any of the operating components 16, such as the battery operated motor, may be fixed to the sub-frame assembly 12 independently of the first and second outer housing assemblies 20, 22.

Alternatively, some or all of the operating components 16 may be required to cooperate with the outer housing assemblies 20, 22 to be operatively maintained on the sub-frame assembly 12.

Certain components 16 may be permanently integrated into the sub-frame assembly 12 so as to be a part thereof. As one example, the aforementioned oil tank may be alternatively: a) integrally formed as part of the sub-frame assembly 12; or b) formed as one of the operating components 16 that is attached to the sub-frame assembly 12.

The same is true of the aforementioned graspable operating handle that may be: a) integrally formed to become part of the sub-frame assembly 12 or; b) a separate operating component 16 that is attached to the sub-frame assembly 12. In the former case, a single piece on the sub-frame assembly may define the graspable operating handle and at least part of a mount location 14 for at least one of the operating components 16.

In an alternative form contemplated within the schematic showings, one of the plurality of operating components 16 may be integrated into one of the first and second outer housing assemblies to define a combination assembly that can be repositioned as one piece to be assembled to, and disassembled from, the remainder of the main operating unit.

The sub-frame assembly 12 may consist of a single piece or multiple joined pieces that define a unitary construction. It is possible in one form to mold the entire sub-frame assembly 12 as a single non-metal piece, Metal construction is, of course, an alternative contemplated construction.

Generally, it is contemplated that the sub-frame assembly 12 is the basic internal (endo-skeletal) building block upon which operating components 16 can be operatively placed and maintained to define either the same configuration for the main operating unit 18 or selectively ones with different performance characteristics.

As shown in FIG. 4, it is contemplated that the main operating unit 18 is usable in combination with a conventional chain bar 30 with an associated cutting chain 32. The chain bar 30 and cutting chain 32 are configured to be operatively assembled to the main operating unit 18 so that the cutting chain 32 can be driven by a battery operated motor that is one of the aforementioned operating components 16.

Certain specific, exemplary, forms of the chain saw kit 10, and other components shown schematically in FIGS. 1-4, will now be described in detail with reference to FIGS. 6 and 7. These specific forms are representative in nature only and are not intended to limit the invention to any depicted part configuration or part interaction. As noted above, the schematic showing of components in FIGS. 1-4 is intended to encompass a wide range of components, with a basic requirement being that the operating component 16 and outer housing assemblies 20, 22 be buildable upon the sub-frame assembly 12 to generate the main operating units 18 with the same or different performance characteristics, essentially in the same manner that conventional gas-powered chain saws, as shown in FIG. 5, are constructed.

Figure 5:
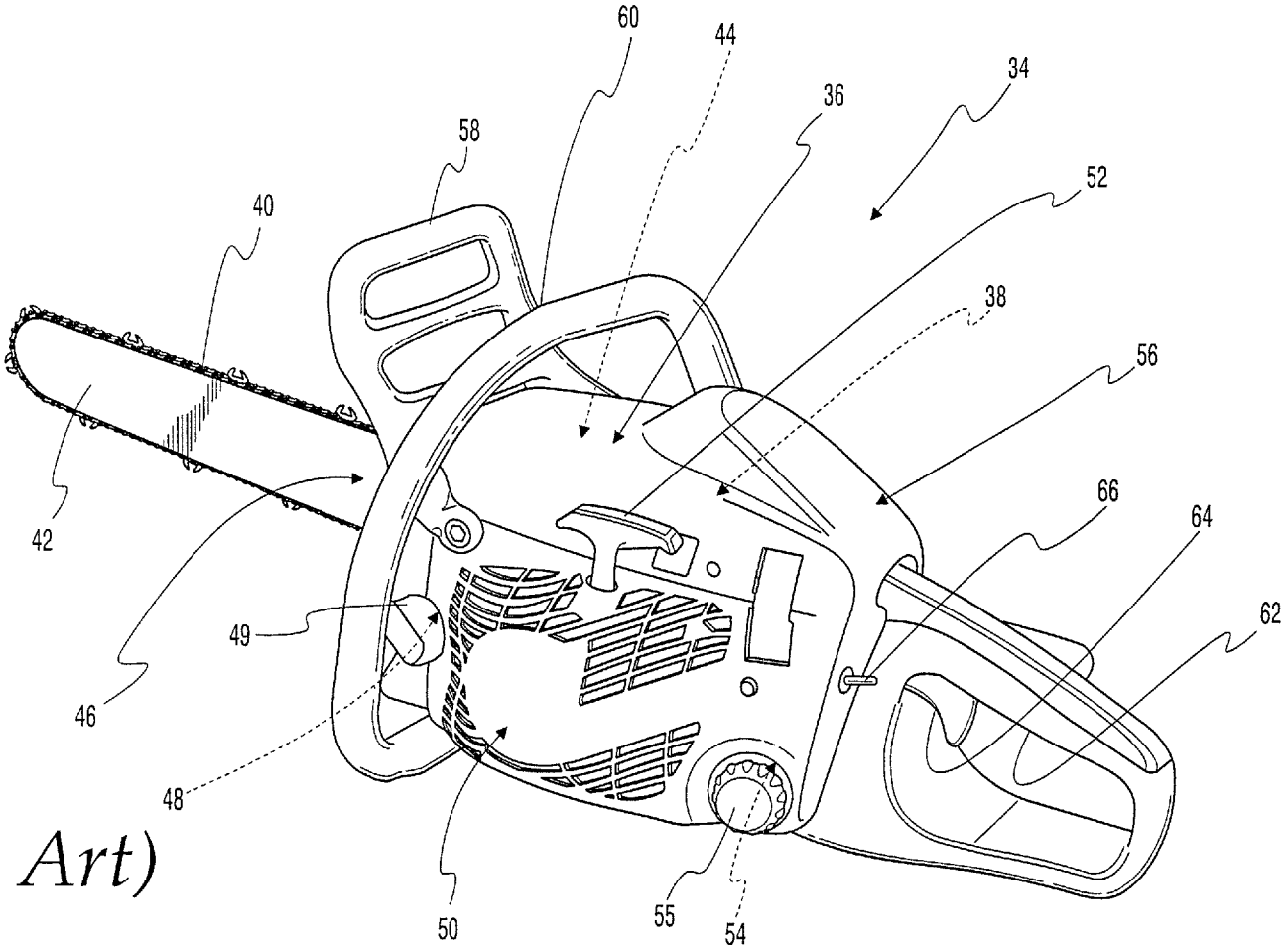
Fig. 5 (Prior Art)
FIG. 5 is a perspective view of a conventional fuel-operated chain saw.

Essentially, the main operating unit 18 with the chain bar 30 and cutting chain 32 in place, has an overall configuration that generally parallels the configuration of a conventional gas-powered chain saw as shown in FIG. 5 at 34. Internal detail of this chain saw 34 is shown in U.S. Pat. No. 9,132,568, the disclosure of which is incorporated herein by reference.

Briefly, the chain saw 34 has an outer housing at 36 which surrounds various internal operating components at 38, including a gas operated engine, a drive transmission between the engine and an endless cutting chain 40 on a chain bar 42, and other known components as shown and described in U.S. Pat. No. 9,132,568. The chain saw 34 has a sub-frame 44 upon which the various operating components are mounted. Among the operating components, aside from the engine which is not directly viewable in FIG. 5, are: a) an exhaust/muffler at the location 46; b) an oil tank 48 containing a lubricant for the cutting chain 40 with a removable cap 49: c) a starter assembly 50, incorporation a starting rope that is drawn through a graspable handle 52; d) a fuel tank 54 with a removable cap 55; e) an air cleaner and cover 56; f) a hand-operable brake system 58 for the cutting chain 40; g) front and rear operating handles 60, 62, respectively; h) a throttle trigger 64; and i) a stop switch 66. This is not an exhaustive identification of the operating components, but depicts a general layout thereof.

Figure 6:
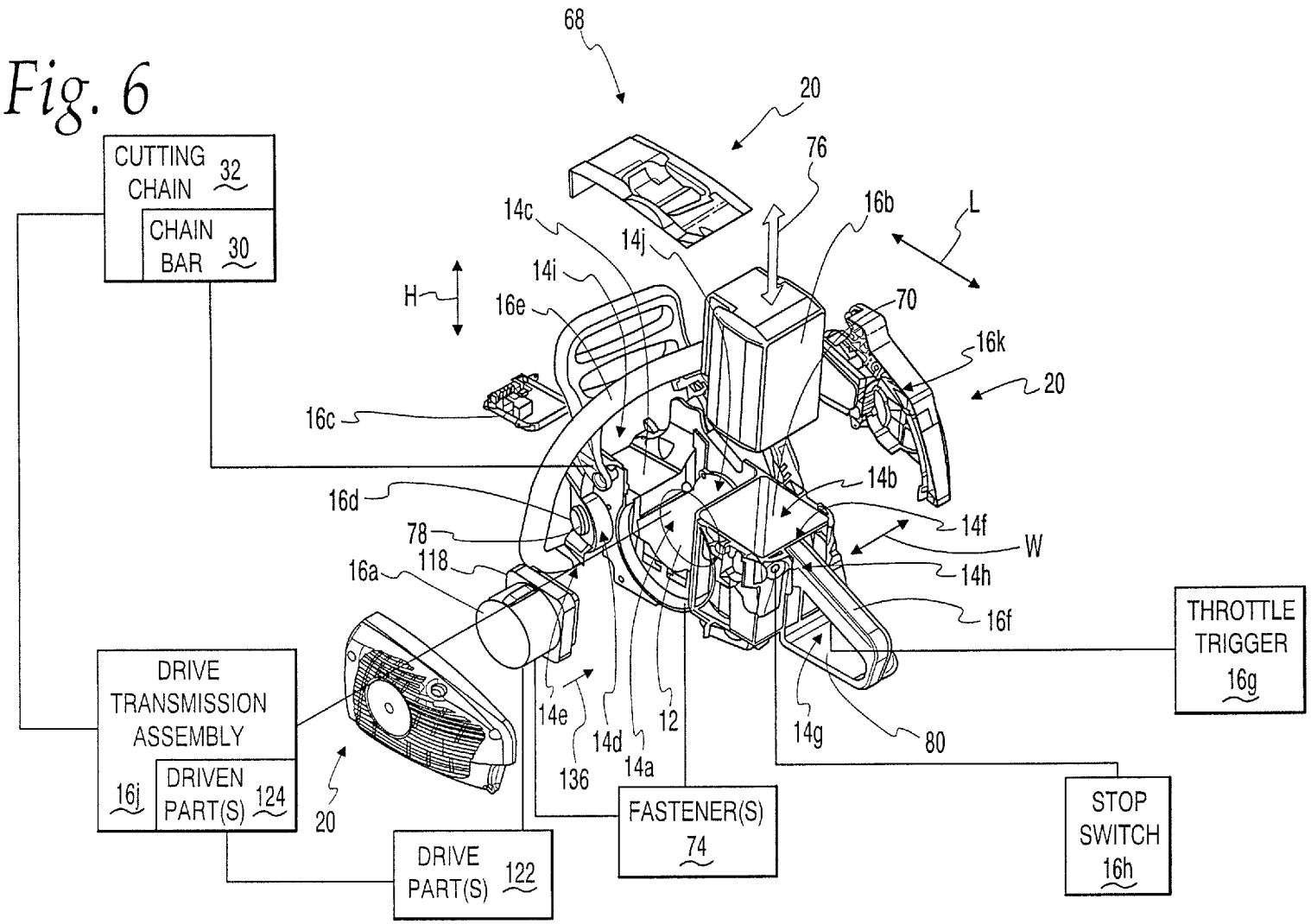
FIG. 6 is an exploded, perspective view of one specific form of the inventive chain saw with a main operating unit having a sub-frame assembly and operating components thereon together with selectively utilizable and different outer housing assembly configurations.
Figure 7:
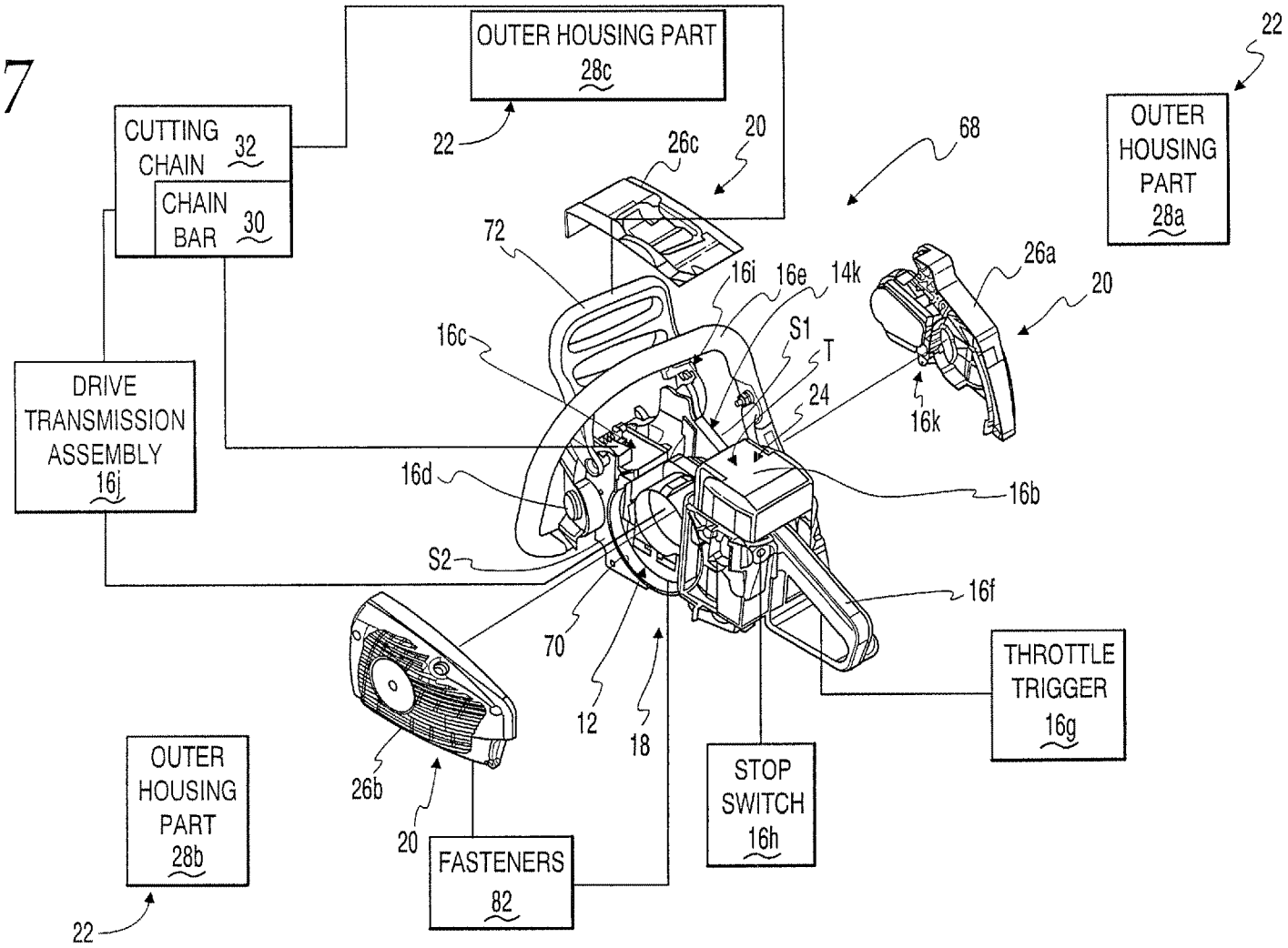
FIG. 7 is a view as in FIG. 6 with the operating components assembled.

As seen in FIGS. 6 and 7, the inventive chain saw at 68, made up of the main operating unit 18, one of the outer housing assemblies 20, 22, and the cutting bar 30 with the cutting chain 32 thereon, has the same overall arrangement of components as shown for the gas-powered chain saw 34, in terms of an endo-skeletal design and location of corresponding components, including engine and motor, etc.

The sub-frame assembly 12 consists of a single piece 70 that defines the mount locations 14 for the various operating components 16. The single piece 70 may be made from a non-metal material, metal material, or a combination thereof. As depicted, the piece 70 has a molded shape that defines the multiple mount locations 14.

Alternatively, multiple parts may be joined to produce a unitary piece making up the sub-frame assembly 12. Whether one piece, or with a unitary construction, the sub-frame assembly 12 will ideally occupy at least 50% of the total volume of the main operating unit 18 and extends over substantially the full vertical extent of the main operating unit 18. These volumes are compared by using the total volumes within a conforming shape circumscribing each of the sub-frame assembly 12 and main operating unit 18 without considering gaps, openings, or hollows.

The unitary or single piece has a height, a width, and a length corresponding to a height H, width W, and length L of the main operating unit 18, as indicated with double-headed arrows in FIG. 6. At least two, and as depicted all, of the height, width, and length of the unitary piece are equal to at least one half of the corresponding height, width, and length of the main operating unit 18. The values for the height H, width W, and length L are compared using either maximum or average dimensions (H,W, and L) for the unitary/single piece and the main operating unit 18.

The unitary piece also occupies a central volume of the main operating unit 18 midway between the sides thereof. The unitary piece extends in a widthwise direction from a widthwise centerline over at least 40% of the overall width of the main operating unit. As depicted this width percentage is greater than 50%.

As depicted, the operating components 16 consist of: a) the battery operated motor 16*a*; b) the battery 16*b* for powering the motor 16*a*; c) a control board assembly 16*c*; d) an oil tank 16*d*; e) graspable front and rear operating handles 16*e*, 16*f*, respectively; f) a throttle trigger 16*g*; g) a stop switch 16*h*; h) a brake assembly 16*i* including an operating handle 72; i) a drive transmission assembly 16*j*; and j) a tensioner assembly 16*k* for controlling tension on the cutting chain 32.

The sub-frame assembly 12 defines a laterally opening, cup-shaped chamber that is the mount location 14*a* for the motor 16*a*. One or more suitable fasteners 74 secure the motor 16*a* fixedly to the sub-frame assembly 12.

The sub-frame assembly 12 defines a cup-shaped, vertically opening receptacle that is the mount location 14*b* for the battery 16*b*. The battery 16*b* can be moved in the line of the double-headed arrow 76 selectively downwardly to electrically connect to the motor 16*a*, and upwardly to be separated from the sub-frame assembly 12 to allow recharging or replacement thereof.

The sub-frame assembly 12 defines a shelf that is the mount location 14*c* for the control board assembly 16*c*.

Forwardly of the motor 16*a*, the oil tank 16*d* is integrated into the sub-frame assembly 12 at the mount location 14*d*. As noted above, the oil tank 16*d* may be an integrally formed, sealable chamber with a fixed configuration on the sub-frame assembly 12 that may be selectively blocked and accessed by a cap 78. Alternatively, the oil tank 16*d* may be a self-contained unit that is added to the sub-frame assembly 12.

The graspable front operating handle 16*e* has the same general configuration as the front operating handle 60 on the chain saw 34 and is placed and secured to the sub-frame assembly 12 forwardly of the motor 16*a* at a mount location 14*e*. The graspable handle 16*e* may alternatively be integrally formed with a single/unitary piece on the sub-frame assembly 12.

The graspable rear operating handle 16*f* likewise has the same general configuration as the operating handle 62 on the chain saw 34. The graspable rear operating handle 16*f* projects from a mount location 14*f* at the rear of the sub-frame assembly 12 and blends into a flat guard piece 80 which shields the user's hand grasping the rear operating handle 16*f*. As noted above, the graspable rear operating handle 16*f* may be integrally formed with the single/unitary piece making up the sub-frame assembly 12, particularly since the motor 16*a* will not produce vibrations of a magnitude adequate to justify isolation of all operating handles as commonly occurs with a gas engine construction. Separate construction and connection to the sub-frame assembly 12 is also contemplated.

The throttle trigger 16*g* is situated at a mount location 14*g* at the underside of the graspable rear operating handle 16*f*.

The stop switch 16*h* is at a mount location 14*h* at the rear of the sub-frame assembly 12 adjacent to the graspable rear operating handle 16*f* so as to be operable as by a user's thumb on a hand that is grasping the rear operating handle 16*f* during normal operation.

The handle 72 on the brake assembly 16*i* is movably mounted in conventional fashion at a mount location 14*i* on the sub-frame assembly 12 to be conveniently accessible by the same hand of a user that is grasping the front operating handle 16*e*.

The drive transmission assembly 16*j* is integrated at a mount location 14*j* that is adjacent to the chamber defined at the mount location 14*a* so as to interact with the motor 16*a* to transmit drive forces from the motor 16*a* to the cutting chain 32.

The tensioner assembly 16*k* is operatively placed on the sub-frame assembly 12 at a front and side mount location 14*k*.

The tensioner assembly 16*k* may be directly connected to the sub-frame assembly 12 on its own. Alternatively, the tensioner assembly 16*k* may be joined to a part 26*a* on the exemplary first outer housing assembly 20 and operatively joined to the sub-frame assembly 12 by reason of the connection of the outer housing part 26*a* to the sub-frame assembly 12. This connection may be a result of the combination of both connecting alternatives—independent and cooperating component mounting.

The tensioner assembly 16*k* may be joined to the sub-frame assembly 12 in the same manner through the outer housing part 28*a* on the second outer housing assembly 22 when the outer housing part 28*a* is used in place of the outer housing part 26*a*.

Alternatively, the outer housing part 28*a* may have an integrated tensioner assembly to define therewith a combination assembly that can be repositioned as one piece to be assembled to and disassembled from the main operating unit 18/sub-frame assembly 12. Integration of the other operating components 16 and outer housing assemblies 20, 22 in like fashion is contemplated for their operative connection to the main operating unit 18/sub-frame assembly 12.

With the endo-skeletal design, the components 16 can be directed towards the sub-frame assembly 12 in virtually any direction into their operative positions to against an exposed region of the sub-frame assembly 12 and/or into receptacles defined therefor. Given the large exposed, outside area of the sub-frame assembly 12, the components can be conveniently and efficiently installed, as on assembly lines, and sized and shaped to produce an overall compact volume.

The invention contemplates that all operating components 16 can be operatively placed and maintained at their respective mount locations 14 independently of, or in conjunction with, the first and second outer housing assemblies 20, 22.

As explained above with respect to the generic version of the invention, with the operating components 16 operatively placed and maintained at the respective mount locations 14, the resulting main operating unit 18 is essentially fully functional and could be used in this state for its intended purpose. While the outer housing assemblies 20, 22 might perform a function other than merely contributing to aesthetics and providing a protective, or redundantly protective, shell, in the depicted form, the main operating unit 18 is, as depicted, preferably functionally the same with or without the outer housing assemblies 20, 22 mounted thereto.

The invention does contemplate that one or more of the outer housing parts 26, 28 could perform some limited function, aside from a basic covering function, or a more significant function. As described above, the outer housing assemblies 20, 22 could be used to maintain operating components 16 on the sub-frame assembly 12. Alternatively, as noted above, the operating components may be operatively maintained fixedly on the sub-frame assembly 12 independently of the outer housing assemblies 20, 22.

The outer housing assemblies 20, 22 may directly overlie the exposed surface 24 of the main operating unit 18 to produce a protective housing, that defines an outermost exposed surface, or may be provided over at least one other layer to perform primarily an aesthetic function by reason of changing the size, shape, and/or appearance of the chain saw 68. As noted above, at least one of the size, shape, and appearance of the chain saw 68 is different depending upon which of the outer housing assemblies 20/22 is utilized.

In the depicted embodiment, the sub-frame 12 with the operating components 16 operatively placed thereon make up the main operating unit 18 that has the exposed surface 24. The outer housing assemblies 20, 22 are shown to directly overlie the exposed surface 24. Each of the depicted outer housing parts 26*a*, 26*b*, 26*c* can be secured in place as by separate fasteners 82 as shown schematically for the outer housing part 28*b*.

As seen in FIGS. 6 and 7, the outer housing parts 28*a*, 28*b*, 28*c*, making up the outer housing assembly 22 and shown schematically in FIGS. 6 and 7, can be substituted for the depicted specific forms of the housing parts 26*a*, 26*b*, 26*c*, and connected to the main operating unit 18 through fasteners 82 or by any suitable means well-known to those skilled in this art. As just one example, snap-type connections might be utilized for the fasteners 82. The use of all other known types of fasteners that are substitutable are contemplated within the generic showing of the fasteners 82 in FIG. 7.

To account for a significant change in appearance of the completed chain saw 68, it is preferred that the outer housing assemblies 20, 22 overlie at least 10% of the area of the exposed surface 24 of the main operating unit 18. More preferably, at least 40% of this area is covered. This percentage may be significantly greater and conceivably substantially the entire area of the exposed surface 24 may be overlaid by the outer housing assemblies 20, 22.

Further, the number of housing parts 26, 28 is not critical to the present invention. It is conceivable that one outer housing part 26, 28 might be utilized. In the exemplary form, three such parts 26*a*, 28*a*; 26*b*, 28*b*; 26*c*, 28*c* are utilized successively at the side regions S1, S2 and top region T of the exposed surface 24. These are only exemplary locations and shapes for the outer housing parts 26, 28.

With one exemplary form, the outer housing assembly has at least one part, and as depicted in FIGS. 6 and 7, three parts 26*a*, 26*b*, 26*c*, each of which overlies only one of the top T, front F, rear R, and spaced side S1, S2 regions. In each case, the housing assembly parts 26*a*, 26*b*, 26*c* each has an area that overlies at least one half of the exposed surface area of corresponding regions on the main operating unit 18. The exemplary housing assembly part 26*c* is configured and attached to the sub-frame assembly 12 so as not to alter function of the main operating unit 18. Rather, it acts as an exposed and decorative "skin". Other housing assembly parts may perform this limited function, or may perform one or more additional functions.

The visual appearance can be changed by potentially changing nothing more than color, applying different markings, decals, etc. Significantly different sizes and shapes of the outer housing parts 26, 28 may permit a very significant change in appearance of the chain saw 68, as to distinguish between models and brands that have different constructions by reason of providing different operating components 16 on the sub-frame assembly 12. As noted above, as one example, different motors can be utilized to produce different chain saw models built on the same sub-frame assembly 12. Different brands might be distinguished by the different outer housing parts 26, 28 which may have the same, or some different, operating components 16 on the same sub-frame assembly 12.

It is important to note that all of the outer housing parts 26, 28 utilized need not be from only one of the outer housing assemblies 20, 22. Parts 26, 28 from the different outer housing assemblies 20, 22 might be combined to produce a chain saw construction with a desired look.

The sub-frame assembly 12 may have a single piece that defines all of the mount locations 14. Preferably, at least a plurality of the mount locations are formed by a single piece made from metal or a non-metal material, such as a plastic, a composite, etc. Multi-part sub-frame assembly constructions are contemplated with it desirable that the resulting sub-frame assembly have a fixed and rigid construction to provide a solid foundation for the operating components 16 and the outer housing assemblies 20, 22.

As a still further modification, as shown in dotted lines in FIG. 1, the chain saw kit 10 may further include a modified sub-frame assembly 12' that can be used in place of the sub-frame assembly 12 for certain chain saw constructions desired. The desired sub-frame construction can be selected as one of the initial manufacturing steps, after which the operating components 16 are serially added.

Figure 8:
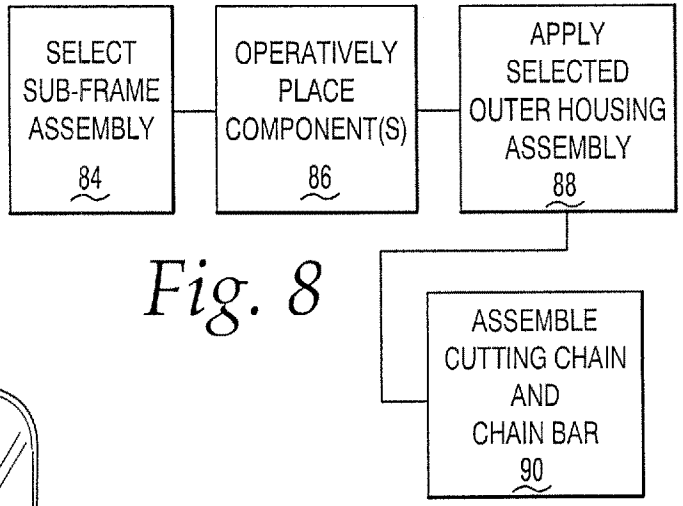
FIG. 8 is a flow diagram representation of a method of manufacturing a chain saw, according to the present invention.

With the inventive concepts, a chain saw can be manufactured as shown in flow diagram form in FIG. 8. As shown therein at block 84, a sub-frame assembly is selected, potentially from a number of sub-frame assemblies, having different constructions, to accommodate different parts or permit a different assembly method.

As shown at block 86, at least one operating component is operatively placed on the selected sub-frame assembly.

As shown at block 88, a selected outer housing assembly (or a mix of parts from separate outer housing assemblies)

is applied to the main operating unit that results from the placement of the operating components on the selected sub-frame assembly. This configuration can be offered by itself. Alternatively, as shown at block 90, a cutting chain and chain bar can be assembled to produce a fully operable chain saw.

The ability to construct chain saws as described above has many potential advantages. First of all, by using the sub-frame assembly to produce an "endo-skeletal" design, battery operated chain saws can be constructed using techniques more in line with those used to construct gas-powered chain saws. Potentially existing assembly lines and tooling and equipment thereon can be readily adapted to change from the gas operated to the battery operated chain saw lines. Expertise acquired by personnel over potentially decades might be adapted readily to the battery powered chain saw design and construction.

By using an endo-skeletal construction versus an exo-skeletal construction, as is currently common to battery operated chain saw constructions, a more rigid structure can potentially be built. With the foundation of an exo-skeletal design effectively encasing the operating components, the chain saw is prone to being distorted and more readily damaged from externally applied forces in use. This is particularly a problem since chain saws are operated in extreme environments and are anticipated to be subjected to tremendous stresses, bending forces, and impacts.

Aside from allowing utilization of acquired familiar design and manufacturing techniques, the battery operated chain saws made according to the invention can readily incorporate all safety features that have proven over the years to be critical in the safe operation of fuel powered chain saws.

With the inventive concept, change in look and function of battery operated chain saws is facilitated, potentially relatively inexpensively. It is also possible to offer consumers after-market options to change features and appearance of chain saws.

Whereas an exo-skeletal chain saw design may make it difficult to inexpensively access internal components, and effect repair and re-assembly, the endo-skeletal design contemplated herein offers the assembly, disassembly, and servicing convenience made possible over decades of evaluation of the basic gas powered chain saw technology.

In one preferred form, the endo-skeletal sub-frame assembly 12 and operating components assembled thereto together define a main operating unit that is fully operational without an outer case housing assembly thereon. This gives greater flexibility as to the construction of the outer housing assembly, which is not required for structural stability in the endo-skeletal designs. This is in contrast to an exo-skeletal construction wherein the outer housing assembly provides the primary structural stability for the chain saw.

At the same time, the components can be built up over a substantial, exposed area of the endo-skeletal sub-frame assembly, potentially directed into place from the top, bottom, sides, front, and rear of the sub-frame assembly. This is advantageous compared to introducing components through a top opening design, as described in the Background section above, wherein components are introduced into, and withdrawn from, the exo-skeletal assembly defining the component receptacle essentially by moving along only a vertical line. With the endo-skeletal design, removal of some or all of the outer housing assembly exposes components on the frame assembly for easy access from potentially all directions on the frame assembly. Because there is a large exposed area on the endo-skeletal sub-frame to accept components, the components do not have to be stacked, which facilitates assembly and removal thereof. This also makes possible a compact volume for the main operating unit.

Figure 9:
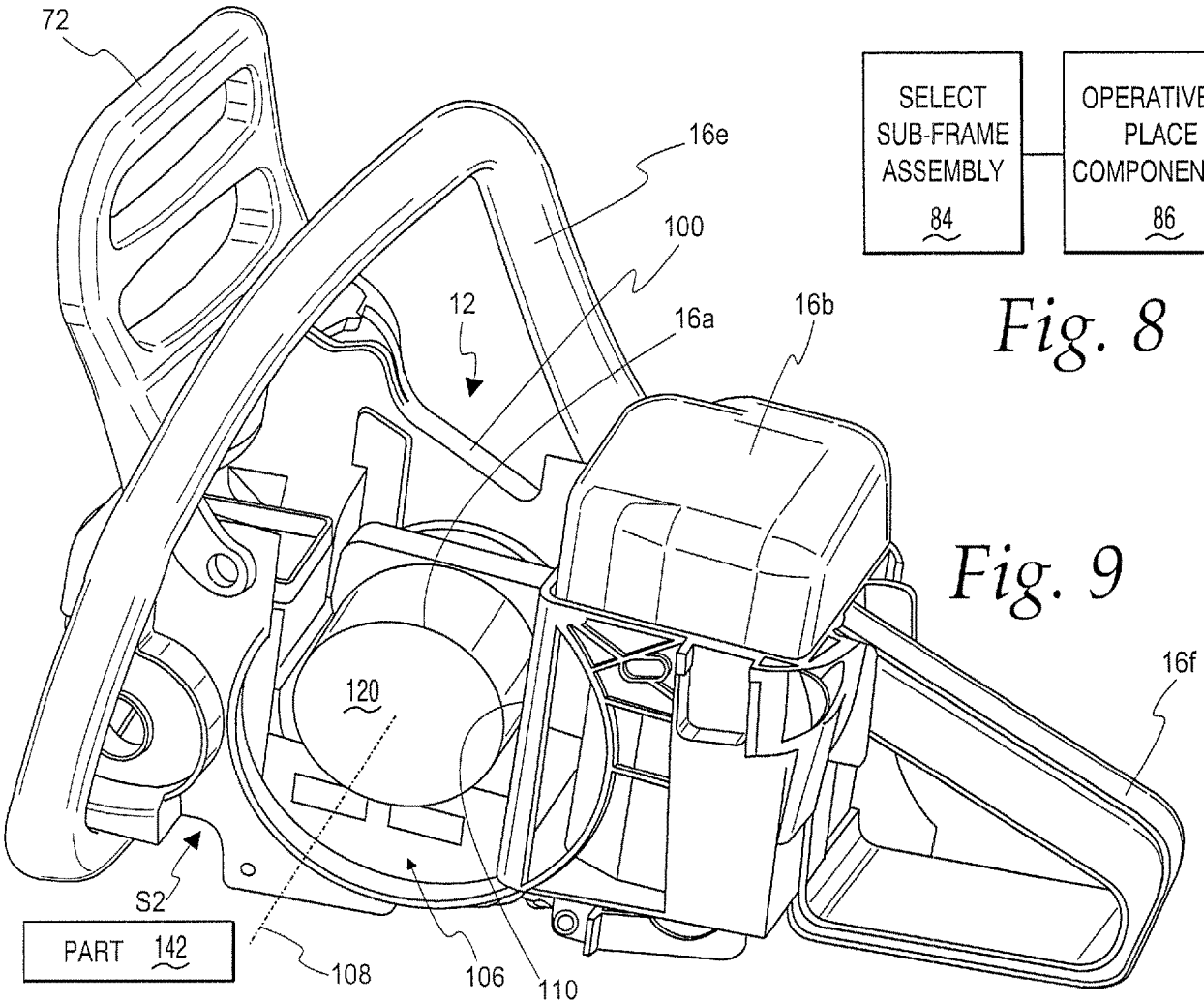
FIG. 9 is an enlarged, perspective view of the sub-frame assembly shown in FIGS. 6 and 7 with certain operating components operatively positioned thereon, including a battery operated motor.

In FIGS. 9-11, additional details are shown which clarify how one form of the inventive operating unit 18 can be constructed. As depicted, the unitary endo-skeletal sub-frame assembly 12 has a unitary body 100 that may be formed as one piece. As depicted, the operating handle **16*e* and operating handle 72 are separate components, attached to the body 100. As noted above, the handle 16*e* might be permanently formed with the body 100, as by being made as one piece therewith. For purposes of explanation hereinbelow, the endo-skeletal sub-frame assembly 12 excludes the handles 16*e* and 72. Accordingly, the endo-skeletal sub-frame assembly 12 has an overall height SFH between a top edge 102 of the body 100 and a bottom edge/surface 104 of the body 100**.

For purposes of explanation hereinbelow, the designations top (T), bottom (B), spaced sides (S1, S2), rear (R), and front (F), used above for the main operating unit 18, will be used as well to identify corresponding regions on the endo-skeletal sub-frame assembly 12.

The body 100 has a stepped opening 106 therein formed through the side S2 with a laterally extending horizontal axis 108. A smaller diameter portion 110 of the opening 106 has an effective diameter that is bounded by a non-round surface arrangement extending around the axis 108. More specifically, the smaller diameter portion 110 is bounded by three flat surfaces 112, 114, 116 that produce a U-shaped receptacle for a complementarily-shaped mounting portion 118 on the motor **16*a*. The surfaces 112, 116 face each other, with the surface 114 orthogonal to the surfaces 112, 116 to produce a combined "U" shape. The opening portion 110 is unbounded at the top. For purposes of simplicity herein, the opening portion 110 will be considered to have an effective diameter D1 equal to the width W of the mounting portion 118**.

A main body 120 of the motor **16*a* has a cylindrical shape with a diameter D2 that is slightly less than the diameter D1**.

The motor **16*a* has a shaft 122 that defines a drive part 122 for the drive transmission assembly 16*j*, as shown schematically in FIG. 6. The shaft 122 may directly engage and turn one or more driven parts 124 on the drive transmission assembly 16*j*. The shaft 122 as depicted makes up the only drive part. Alternatively, the shaft 122 may support one or more additional parts that cooperate with the driven part(s) 124 on the drive transmission assembly 16*j***.

The larger diameter portion 126 of the opening 106 provides a main access volume for the motor **16*a*, once operatively positioned, and also facilitates direction of the motor 16*a* into its operative position. The opening portion 126 accommodates a person's fingers grasping the outer perimeter of the body 120 of the motor 16*a* as it is pressed into, and withdrawn from, its operative position. The larger diameter portion 126 is shown to be bounded partially around the axis 108 by an arcuate surface 128** that is interrupted at a top region.

Continuous extension of the surfaces 112, 114, 116 and 128 about their respective opening portions 110, 126 is also contemplated.

With the opening 106 provided, assembly of the motor **16*a* might be effected in different manners. In one manner, the motor 16*a* may assume a pre-assembly position, shown in dotted lines in FIG. 10, directly over its final operative position. With oppositely facing surfaces 128, 130 on the mounting portion 118 of the motor 16*a* aligned in fore-andaft and lateral directions, respectively with the surfaces 112, 116 on the body 100, the motor 16***a* can be advanced downwardly in a path identified by the arrow 132, orthogonally to an operating axis 134 for the motor 16*a*, and guided by the cooperating surfaces 112, 128 and 116, 130 into its operative position as shown in FIGS. 9 and 10. The motor 16*a* and drive transmission assembly 16*j* may be constructed so that the cooperating drive and driven parts 122, 124 thereon may engage to interact without relative lateral movement between the motor 16*a* and the body 100.

Alternatively, the motor 16*a* may be spaced laterally outwardly from its operative position as shown in FIGS. 9 and 10 in a pre-assembly position as shown in FIG. 6. The motor 16*a* can then be advanced laterally towards the body 100 in a path following a horizontal line, as indicated by the arrow 136, parallel to the shaft axis 134, whereupon the shaft 122 projects through an opening 138 in the body 100 to engage the driven part(s) 124 on the drive transmission assembly 16*j*.

In a further alternative, as shown in FIG. 11, a pre-assembly position can be similar to that shown in FIG. 6 but wherein the motor 16*a* is lowered to be in lateral coincidence with the body 100, whereupon the motor 16*a* can be translated laterally a shorter distance in the horizontal path as indicated by the arrow 136.

While the axes 108, 134 are shown to be substantially coincident with the motor 16*a* operatively positioned, this is not a requirement. Virtually any opening configuration to accept a part of the motor 16*a* is contemplated.

In a still further variation, the motor 16*a* might be directed against the body 100 in a lateral direction without any accommodating opening corresponding to the opening 106.

In the form depicted, the opening 106 extends to adjacent the bottom edge/surface 104 at the bottom of the endo-skeletal sub-frame assembly 12. As mentioned above, the presence of the opening 106 provides a clearance volume that allows an individual to access the motor 16*a* from a laterally spaced position to facilitate handling thereof, during assembly and disassembly. As noted in the previous paragraph, the opening 106 is not required to install the motor 16*a* which can be directed laterally to against the body 100 from the side S2 thereof. This alternative construction affords many of the advantages described herein.

It is also contemplated that the motor 16*a* might be mounted other than by directing the same laterally against the body 100 and that one or more of the other components 16 might be placed into its operative position in this manner, i.e., through lateral advancement relative to the endo-skeletal sub-frame assembly 12.

In FIG. 12, a more generic version of an outer housing assembly for the main operating unit 18 is shown at 140. The outer housing assembly 140 may consist of a single part or multiple parts 142. The generic showing is intended to encompass the multi-part housing construction as described above, as well as one potentially wherein there is a single part utilized.

Referring again to FIGS. 9-11, exemplary part 142 is shown making up the outer housing assembly 140 at the side S2 of the endo-skeletal sub-frame assembly 12. The outer housing assembly part 142, as shown in its operative position in dotted lines in FIG. 10, directly overlies the exposed surface 24 on the main operating unit 18 including the sub-frame assembly 12. The part 142 in FIG. 10 fully blocks the opening 106 as viewed in a horizontal direction from the side S2 of the endo-skeletal sub-frame assembly 12. By changing the shape/dimension of the part 142, it may only partially block the motor 16*a*, as viewed in a horizontal direction from the side S2 of the endo-skeletal sub-frame assembly, as in FIG. 10. It is desirable that the part 142 block a substantial area of the motor 16*a* viewed from the side perspective of FIG. 10.

Using another design parameter, the part 142 may be constructed so that in its operative position it blocks movement of the motor 16*a* from its operative position oppositely to the direction along the assembly path from the pre-assembly position, as indicated by the arrow 36. That is, the part 142 prevents full separation of the motor 16*a* from the sub-frame assembly 12 by reversing movement along the horizontal, translational assembly path.

Generally, the basic function desired is achieved by letting the housing assembly part 142, or another part, of the outer housing assembly 140 extend downwardly from the top of the main operating unit 18 to a location closer to the bottom of the main operating unit 18 than the top of the main operating unit 18. In this embodiment, the outer housing assembly 140 is made up of at least the part 142, that extends to at least adjacent the bottom of the main operating unit 18 and the bottom edge/surface 104.

Further, with the outer housing assembly 140 fully assembled, the part 142 overlies a majority of an exposed area of the side S2 of the main operating unit 18/endo-skeletal sub-frame assembly 12.

As further depicted for at least the housing assembly part 142, when fully assembled, the outer housing assembly extends over at least one half a vertical extent of the endo-skeletal sub-frame assembly 12. As depicted, the housing assembly part 142 extends over approximately 80% of the vertical extent of the endo-skeletal sub-frame assembly 12, excluding the handles 16*e*, 72.

As described earlier, with the outer housing assembly 140 removed, the main operating unit 18 is preferably functionally the same. The chain bar 30 and cutting chain 32 may be operatively assembled to the main operating unit 18 without the outer housing assembly 140 and with the resulting assembly fully functional in that state.

With the above structure, a method of constructing a chain saw unit for a chain saw, of the type including a chain bar and cutting chain, can be carried out as shown in flow diagram form in FIG. 13.

As shown at block 150, various components are obtained. These components include: a) an endo-skeletal sub-frame assembly defining a plurality of mount locations; b) a plurality of operating components including at least: i) a battery-operated motor; and ii) a drive transmission assembly through which a cutting chain can be driven by the battery-operated motor; and c) an outer housing assembly.

As shown at block 152, one of the operating components is directed laterally into an operative position at one of the mount locations at one of the sides of the endo-skeletal sub-frame assembly.

As shown at block 154, at least one of the operating components, and preferably a plurality of the operating components, are placed in operative positions, each at one of the mount locations, to define a main operating unit.

As shown at block 156, after directing the at least one of the operating components into its operative position, at least a part of the outer housing assembly is placed in an operative position with respect to the endo-skeletal sub-frame assembly wherein the at least part of the outer housing assembly overlies part of an exposed surface area of the main operating unit and blocks access to the operatively positioned one component from the one side of the endo-skeletal sub-frame assembly.

In the event that the endo-skeletal sub-frame assembly has an opening, as in the exemplary embodiment described above, to accept the one operating component, the method shown in FIG. 13 is modified by configuring the outer housing assembly so that in its operative position with respect to the endo-skeletal sub-frame assembly, the part of the outer housing assembly blocks access to the operatively positioned one component through the opening from a horizontal perspective at the one side of the endo-skeletal sub-frame assembly.

The foregoing disclosure of specific embodiments is intended to be illustrative of the broad concepts comprehended by the invention.

The invention claimed is:

1. A method of constructing a chain saw unit for a chain saw of the type including a chain bar and a cutting chain guided in movement by the chain bar, the method comprising the steps of;

obtaining: a) an endo-skeletal sub-frame assembly defining a plurality of mount locations; b) a plurality of operating components including at least: i) a battery operated motor; and ii) a drive transmission assembly through which a cutting chain can be driven by the battery operated motor; and c) an outer housing assembly, wherein the endo-skeletal sub-frame assembly has a top, a bottom, a front, a rear, and laterally spaced sides;

directing one of the operating components from a pre-assembly position into an operative position at one of the mount locations, wherein one of the sides of the endo-skeletal sub-frame assembly has an opening through which the operatively positioned one component is exposed to be accessed from the one side of the endo-skeletal sub-frame assembly;

placing additional ones of the operating components in operative positions, each at one of the mount locations, to define a main operating unit to which the chain bar and cutting chain can be operatively assembled so that the cutting chain can be driven by the battery operated motor, the main operating unit having an exposed surface area, a top, a bottom, and spaces sides; and after directing the one of the operating components into its operative position, placing at least a part of the outer housing assembly in an operative position with respect to the endo-skeletal sub-frame assembly wherein the at least part of the outer housing assembly overlies part of the exposed surface area of the main operating unit and blocks access to the operatively positioned one component through the opening from the one side of the endo-skeletal sub-frame assembly.

2. The method of constructing a chain saw unit according to claim 1 wherein the one operating component is the battery operated motor.

3. The method of constructing a chain saw unit according to claim 2 wherein the at least part of the housing assembly in its operative position substantially fully blocks the battery operated motor as viewed in a horizontal direction from the one side of the endo-skeletal sub-frame assembly.

4. The method of constructing a chain saw unit according to claim 2 wherein the battery operated motor is moved laterally in a first direction in a horizontal path between the pre-assembly position into the operative position and the at least part of the housing assembly in its operative position blocks movement of the battery operated motor from its operative position oppositely to the first direction in the horizontal path.

5. The method of constructing a chain saw unit according to claim 2 wherein the outer housing assembly extends downwardly from the top of the main operating unit to a location closer to the bottom of the main operating unit than the top of the main operating unit and the battery operated motor is fixed to the endo-skeletal sub-frame assembly independently of the outer housing assembly whereby an entirety of the outer housing assembly can be separated from the endo-skeletal sub-frame assembly without changing how the battery operated motor is maintained on the endo-skeletal sub-frame assembly.

6. The method of constructing a chain saw unit according to claim 5 wherein the outer housing assembly extends to at least adjacent the bottom of the main operating unit.

7. The method of constructing a chain saw unit according to claim 6 wherein the at least part of the outer housing in its operative position fully blocks access to the operatively positioned one component from the one side of the endo-skeletal sub-frame assembly.

8. The method of constructing a chain saw unit according to claim 1 wherein the opening extends to adjacent the bottom of the endo-skeletal sub-frame assembly.

9. The method of constructing a chain saw unit according to claim 1 wherein the endo-skeletal sub-frame assembly comprises a unitary piece that defines at least one graspable handle.

10. The method of constructing a chain saw unit according to claim 9 wherein the unitary piece comprises a single piece.

11. The method of constructing a chain saw unit according to claim 10 wherein the single piece is a molded plastic piece.

12. The method of constructing a chain saw unit according to claim 1 wherein the at least part of the housing assembly in its operative position fully blocks the opening as viewed in a horizontal direction from the one side of the endo-skeletal sub-frame assembly.

13. The method of constructing a chain saw unit according to claim 1 wherein the at least part of the housing assembly in its operative position directly overlies the exposed surface area of the main operating unit.

14. The method of constructing a chain saw unit according to claim 1 wherein the at least part of the housing assembly in its operative position directly overlies the endo-skeletal frame assembly.

15. The method of constructing a chain saw unit according to claim 1 wherein the main operating unit is functionally the same with and without the outer housing assembly in the operative position with respect to the endo-skeletal sub-frame assembly.

16. The method of constructing a chain saw unit according to claim 1 further comprising the steps of operatively assembling the chain bar and cutting chain to the main operating unit.

17. The method of constructing a chain saw unit according to claim 1 wherein with the chain saw unit fully assembled the outer housing assembly overlies a majority of an exposed area of one of the sides of the main operating unit.

18. The method of constructing a chain saw unit according to claim 1 wherein with the chain saw unit fully assembled the outer housing assembly extends over one half a vertical extent of the one side of the endo-skeletal sub-frame assembly.

19. A chain saw unit made according to the method of claim 1.

20. A method of constructing a chain saw unit for a chain saw of the type including a chain bar and a cutting chain guided in movement by the chain bar, the method comprising the steps of:

obtaining: a) an endo-skeletal sub-frame assembly defining a plurality of mount locations; b) a plurality of operating components including at least: i) a battery operated motor; and ii) a drive transmission assembly through which a cutting chain can be driven by the battery operated motor; and c) an outer housing assembly, wherein the endo-skeletal sub-frame assembly has a top, a bottom, a front, a rear, and laterally spaced sides;

the endo-skeletal sub-frame assembly defining a rear graspable handle that can be engaged by a user;

directing one of the operating components laterally into an operative position at one of the mount locations at one of the sides of the endo-skeletal sub-frame assembly;

placing additional ones of the operating components in operative positions, each at one of the mount locations, to define a main operating unit to which the chain bar and cutting chain can be operatively assembled so that the cutting chain can be driven by the battery operated motor, the main operating unit having an exposed surface area, a top, a bottom, and spaced sides; and after directing the one of the operating components into its operative position, placing at least a part of the outer housing assembly in an operative position with respect to the endo-skeletal sub-frame assembly wherein the at least part of the outer housing assembly overlies part of the exposed surface area of the main operating unit and blocks access to the operatively positioned one component from the one side of the endo-skeletal sub-frame assembly.

21. The method of constructing a chain saw unit according to claim 20 wherein the one operating component is the battery operated motor.

22. The method of constructing a chain saw unit according to claim 20 wherein the outer housing assembly extends to at least adjacent the bottom of the main operating unit.

23. The method of constructing a chain saw unit according to claim 20 wherein the at least part of the outer housing assembly in its operative position fully blocks access to the operatively positioned one component from the one side of the endo-skeletal sub-frame assembly.

24. A chain saw unit made according to the method of claim 20.

* * * * *